US007533496B2

(12) United States Patent
Tremble et al.

(10) Patent No.: US 7,533,496 B2
(45) Date of Patent: May 19, 2009

(54) UPPER SASH DETENT LATCH FOR A DOUBLE-HUNG WINDOW

(75) Inventors: John Tremble, Redmond, WA (US); Hong Chen, Surrey (CA); Jacob Rebel, Langley (CA)

(73) Assignee: Milgard Manufacturing, Inc., Tacoma, WA (US)

( * ) Notice: Subject to any disclaimer, the term of this patent is extended or adjusted under 35 U.S.C. 154(b) by 644 days.

(21) Appl. No.: 11/397,769

(22) Filed: Apr. 4, 2006

(65) Prior Publication Data

US 2007/0227075 A1 Oct. 4, 2007

(51) Int. Cl.
*E05B 55/00* (2006.01)

(52) U.S. Cl. ..... 49/449; 292/DIG. 15

(58) Field of Classification Search ..... 49/449, 49/451; 292/80, 87, DIG. 15; 16/82
See application file for complete search history.

(56) References Cited

U.S. PATENT DOCUMENTS

| | | | | |
|---|---|---|---|---|
| 21,968 | A | 11/1858 | Judd | |
| 178,292 | A | 6/1876 | Hale | |
| 449,895 | A | 4/1891 | Bangs | |
| 517,602 | A | 4/1894 | Cole | |
| 690,440 | A | 1/1902 | Kemp | |
| 692,532 | A | 2/1902 | Maloon | |
| 754,452 | A | 3/1904 | Howe | |
| 764,493 | A | 7/1904 | Noseworthy | |
| 832,505 | A | 10/1906 | Sawyer | |
| 861,070 | A | 7/1907 | Wynn | |
| 1,038,199 | A | 9/1912 | Rast | |
| 1,066,141 | A | 7/1913 | Parsons | |
| 1,259,115 | A | 3/1918 | Lunken | |
| 1,313,840 | A | 8/1919 | Strom et al. | |
| 1,426,445 | A | 8/1922 | Anderson | |
| 1,469,659 | A | 10/1923 | McGuire | |
| 1,530,385 | A | 3/1925 | McGuire | |
| 1,540,525 | A | 6/1925 | Anderson | |
| 1,578,386 | A | 3/1926 | Bingham | |
| 1,587,037 | A | 6/1926 | Rudolph | |
| 1,672,369 | A * | 6/1928 | Chaffee | 49/377 |
| 1,841,890 | A | 1/1932 | Hannon | |
| 2,208,610 | A | 7/1940 | Swallow | |
| 2,287,978 | A | 6/1942 | De Smet | |
| 3,094,347 | A | 6/1963 | May | |
| 3,377,648 | A | 4/1968 | Bloom | |
| 4,238,907 | A | 12/1980 | Swan | |
| 4,420,907 | A | 12/1983 | Swan | |
| 4,482,178 | A | 11/1984 | Damiana | |
| 4,923,230 | A | 5/1990 | Simpson | |
| 5,013,073 | A | 5/1991 | Pehr | |
| 5,192,109 | A | 3/1993 | Roberts | |
| 6,607,221 | B1 | 8/2003 | Elliott | |

* cited by examiner

*Primary Examiner*—Jerry Redman
(74) *Attorney, Agent, or Firm*—Niray D. Parikh

(57) ABSTRACT

A building window includes a generally rectangular frame having an upper rail and opposed side rails. An upper sash and a lower sash are independently movably mounted in the frame. A pair of opposed spring detents are mounted on the side rails adjacent to the upper rail of the frame. A pair of laterally opposed latches are at upper corners of the upper sash at positions to engage the spring detents as the upper sash is moved to its fully raised position. The latches cooperate with the spring detents to hold the upper sash in its fully raised position and are releasable from the spring detents to permit lowering of the upper sash.

14 Claims, 4 Drawing Sheets

UPPER SASH DETENT LATCH FOR A DOUBLE-HUNG WINDOW

The present disclosure relates to double-hung windows, and more particularly to a latch for releasably holding the upper sash in its fully raised closed position.

BACKGROUND AND SUMMARY OF THE DISCLOSURE

In double-hung windows having upper and lower sashes that are movable independently of each other, a typical occurrence is that the upper sash settles or lowers from its fully raised closed position. This can occur, for example, when the upper sash balance springs are not strong enough to hold the upper sash closed, or when closing and locking the lower sash tends to pull the upper sash downwardly. A general object of the present disclosure is to provide a releasable detent arrangement for latching the upper sash in its fully raised closed position while at the same time permitting selective lowering of the upper sash.

The present disclosure embodies a number of aspects that can be implemented separately from or in combination with each other.

A building window in accordance with one aspect of the disclosure includes a generally rectangular frame having an upper rail and opposed side rails. An upper sash and a lower sash are independently movably mounted in the frame. A pair of opposed spring detents are mounted on the side rails adjacent to the upper rail of the frame. A pair of laterally opposed latches are at upper corners of the upper sash at positions to engage the spring detents as the upper sash is moved to its fully raised position. The latches cooperate with the spring detents to hold the upper sash in its fully raised position and are releasable from the spring detents to permit lowering of the upper sash.

Each spring detent preferably has a resilient arm positioned to be engaged by the associated latch as the upper sash is moved toward its fully raised position. The resilient arm preferably has a cam portion that is angulated and disposed to be engaged by the associated latch as the upper sash is raised. Each spring detent preferably also includes a second portion with a ledge for supporting the latch in the fully raised position of the upper sash. Each latch preferably includes a spring-biased latch bolt for camming the resilient arm of the spring detent laterally outwardly as the upper sash is raised and for resting on the ledge portion of the spring detent.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
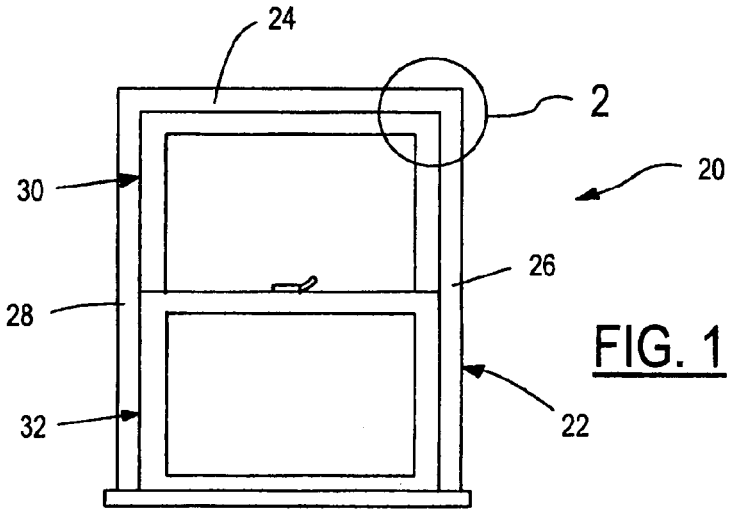
FIG. 1 is an elevational view of a window in accordance with an exemplary embodiment of the disclosure.

FIG. 1 illustrates a building window 20 in accordance with an exemplary embodiment of the disclosure as including a generally rectangular frame 22 having an upper rail 24 and a pair of side rails 26,28. An upper sash 30 and a lower sash 32 are independently movable within frame 22 between respective upper or fully raised positions and lower or fully lowered positions. FIG. 1 illustrates upper sash in its fully raised closed position and lower sash in its fully lowered closed position. A pair of latch mechanisms are disposed at the upper corners of upper sash 30 for holding upper sash 30 in its fully raised position in accordance with the present disclosure. One such latch mechanism 34 is illustrated in detail in FIGS. 2-7, while the opposing latch mechanism is a mirror image of latch mechanism 34.

Latch mechanism 34 includes a spring detent 36 mounted on frame side rail 26 adjacent to frame upper rail 24, and a latch 38 mounted at the upper corner of upper sash 30 at a position to engage spring detent 36 as upper sash 30 is moved to its fully raised position. Spring detent 36 (FIGS. 2 and 4-9) includes a base 39 and an arm 40 resiliently integrally interconnected by an inverted U-shaped connection portion 42. Base 39, in the embodiment of the spring detent illustrated in FIGS. 2-7, is generally U-shaped in lateral cross section and has a pair of spaced oppositely extending hooks 44,46 for securing spring detent 36 within an opening 48 (FIGS. 2 and 4) in side rail 26. Resilient arm 40 includes an angulated cam portion 48 that preferably is flat and oriented at an angle toward base 39. A second portion of arm 40 includes a ledge 50 for engagement by latch 38 as will be described. Spring detent 36 can be formed of one-piece spring steel, for example, in a suitable blanking and bending operation.

Figure 2:
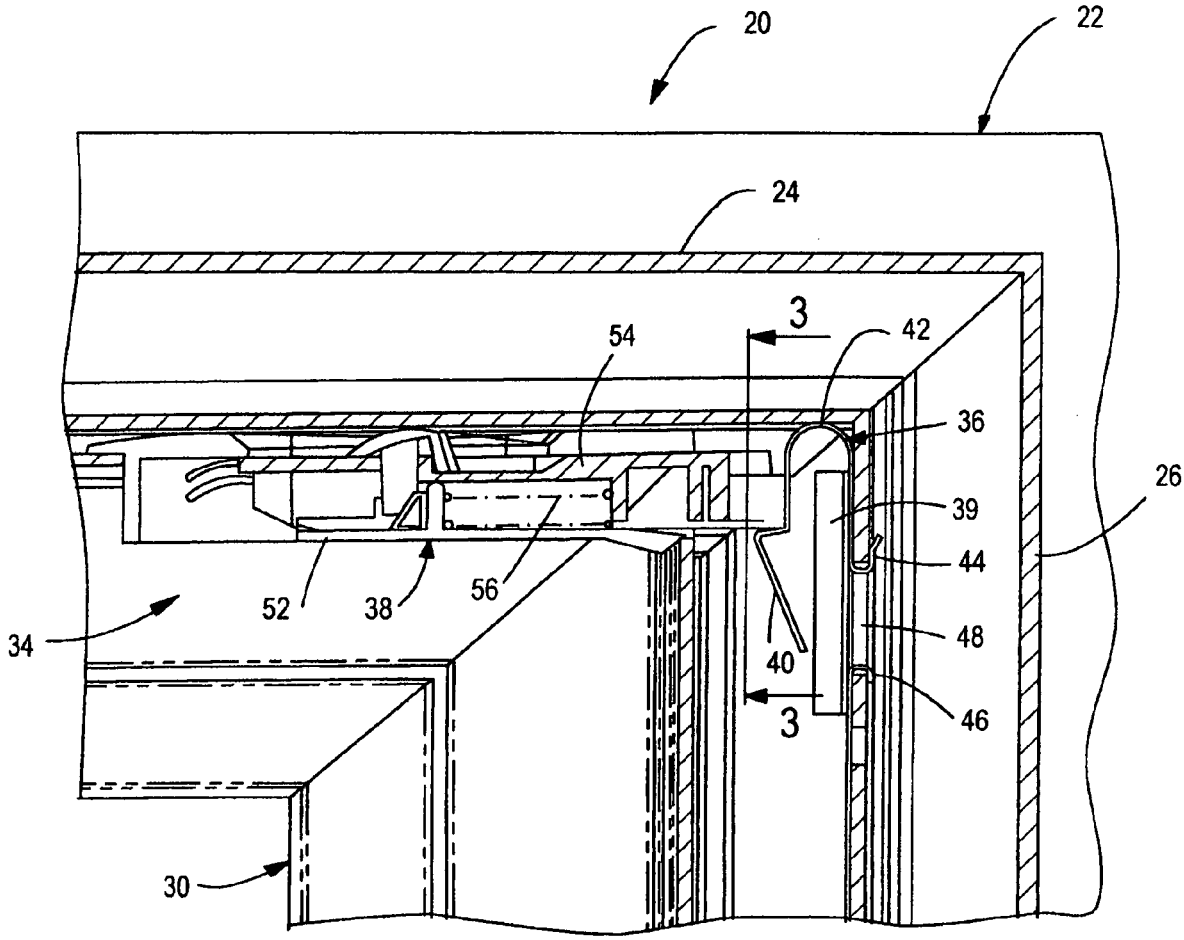
FIG. 2 is a fragmentary sectional view on an enlarged scale of the portion of FIG. 1 within the area 2.
Figure 3:
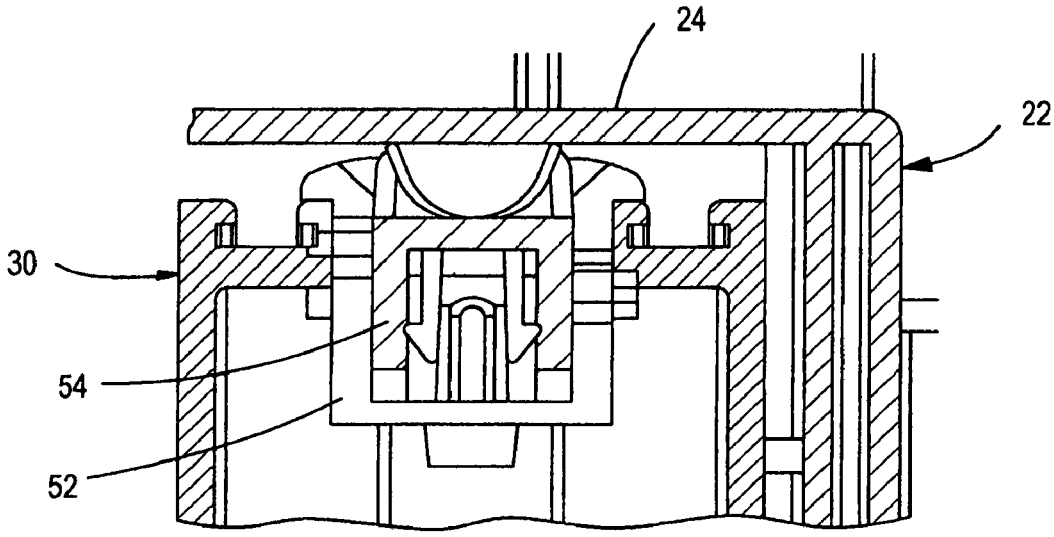
FIG. 3 is a fragmentary sectional view taken substantially along the line 3-3 in FIG. 2.
Figure 5:
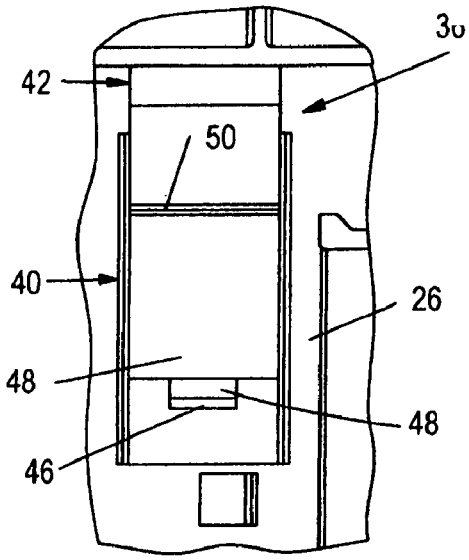
FIG. 5 is a fragmentary sectional view taken substantially along the line 5-5 in FIG. 4.
Figure 4:
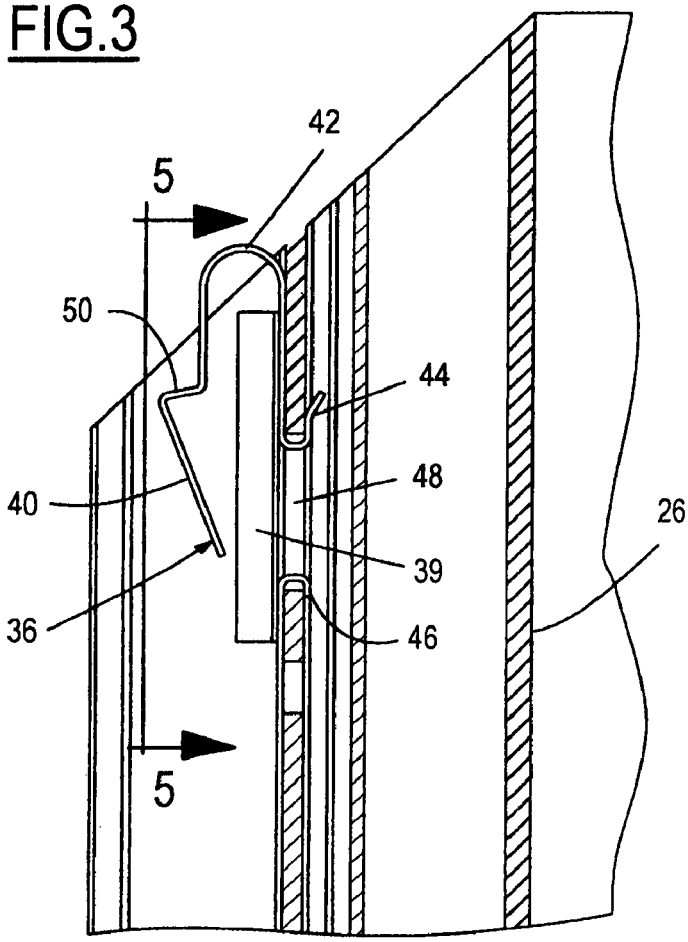
FIG. 4 is a fragmentary sectional view of a side rail in the window frame of FIGS. 1-2.
Figure 6:
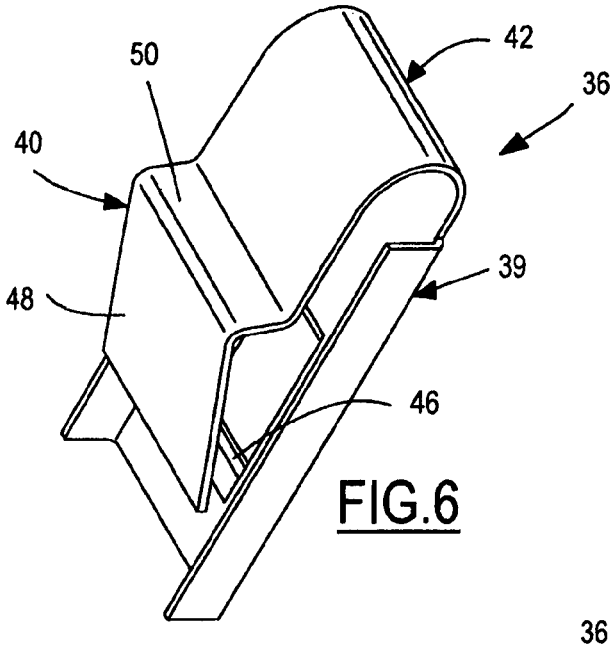
FIG. 6 is a perspective view of a spring detent in accordance with one exemplary embodiment of the disclosure.
Figure 9:
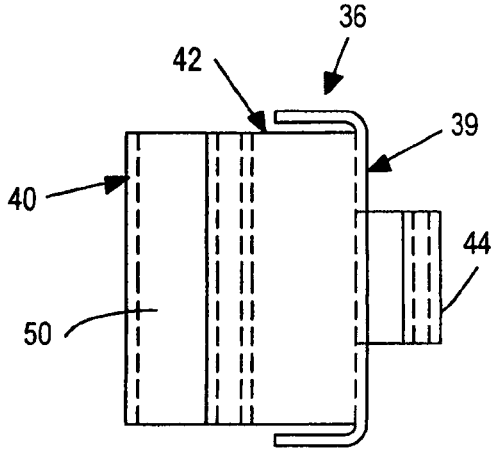
FIG. 9 is a top plan view of the spring detent in FIGS. 6-8.
Figure 8:
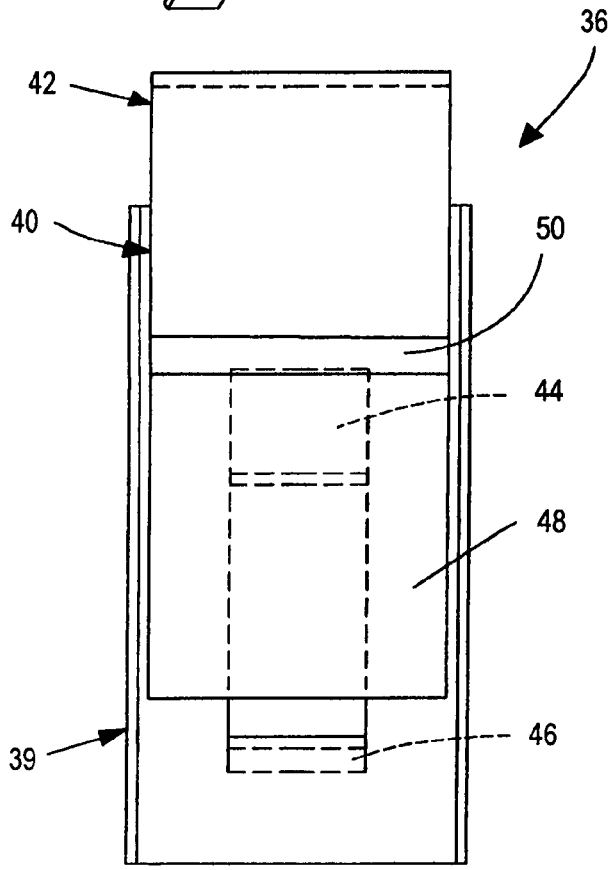
FIG. 8 is a front elevational view of the spring detent in FIGS. 6 and 7.
Figure 7:
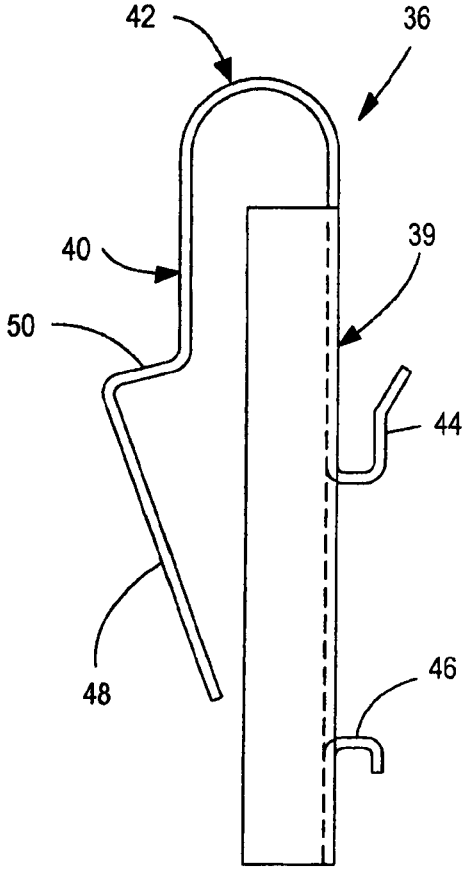
FIG. 7 is a side elevational view of the spring detent in FIG. 6.
Figure 12:
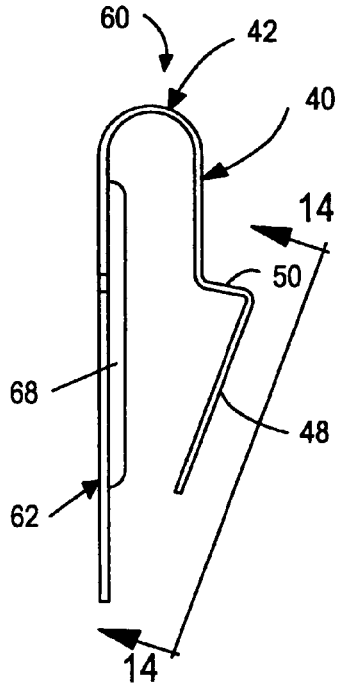
FIG. 12 is a side elevational view of the spring detent in FIGS. 10 and 11.

Latch 38 (FIGS. 2-3) includes a housing 52 secured at the upper corner of upper sash 38, preferably by being received into a laterally extending slot in the upper rail of upper sash 30. A latch bolt 54 is slidably carried within housing 52 and is biased by a spring 56 laterally outwardly with respect to housing 52. As upper sash 30 is moved toward its fully raised position illustrated in FIGS. 1 and 2, the outer end or nose of latch bolt 54 engages cam portion 48 of spring detent resilient arm 40 and urges the resilient spring arm laterally outwardly. (The same action occurs at the opposing side of upper sash 30 not illustrated in the drawings.) Resilient arm 40 thus is moved laterally outwardly to permit passage of latch bolt 54 and latch 38 in the upward direction. When latch bolt 54 clears cam portion 48 of spring detent 36 and registers with ledge 50 of resilient arm 40, resilient 40 snaps laterally inwardly to capture the nose or end of the latch bolt. The ledges 50 of the opposing spring detents thus hold the latches 38 and the upper sash 30 in the fully raised position of the upper sash. It will be noted that ledges 50 of spring detents 36 preferably lie at a slightly downward and inward angle to horizontal. This is best seen in FIGS. 2, 4 and 7. The opposing lower outside noses of latch bolts 54 may have a complementary angle. The ledges 50 act as cams to urge spring detent access 40 outwardly when upper sash 30 is pulled down. Arms 40 can be calibrated, for example, to five pounds of actual force each to release the upper sash.

Figure 10:
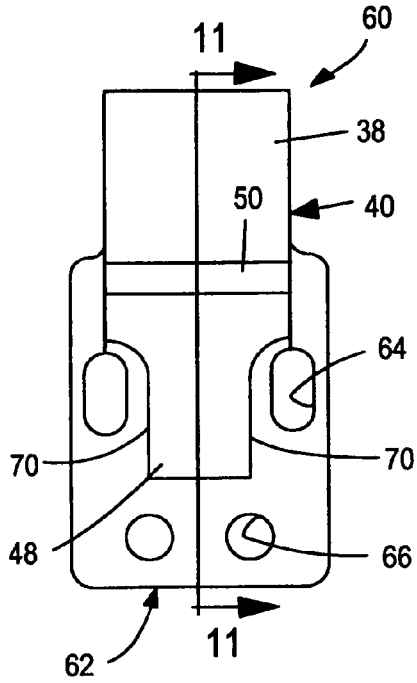
FIG. 10 is a front elevational view of a spring detent in accordance with another exemplary embodiment of the disclosure.
Figure 11:
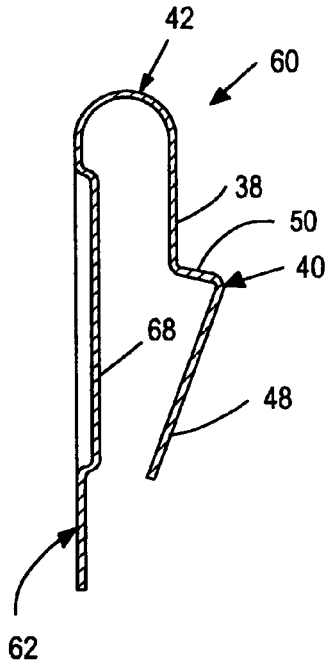
FIG. 11 is a sectional view taken substantially along the line 11-11 in FIG. 10.
Figure 13:
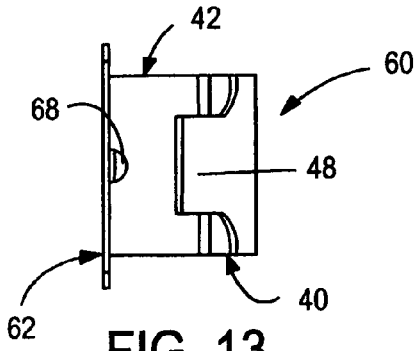
FIG. 13 is a bottom plan view of the spring detent in FIGS. 10-12.
Figure 14:
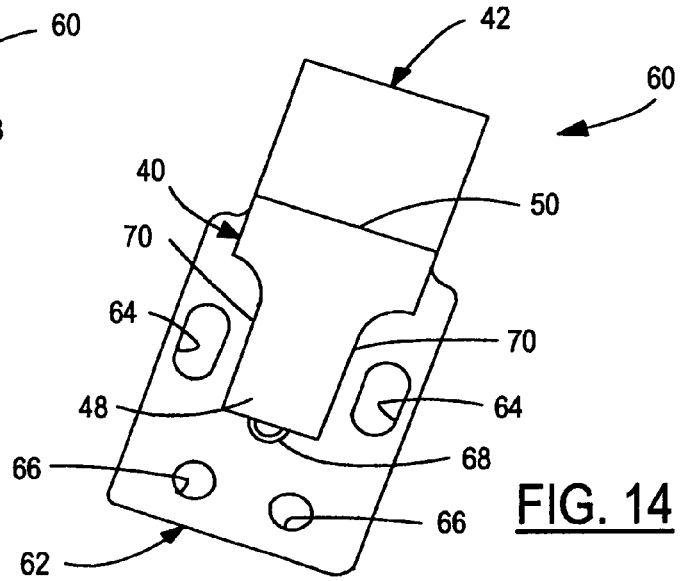
FIG. 14 is a view taken substantially from a direction 14-14 in FIG. 12.

FIGS. 10-14 illustrate a spring detent 60 in accordance with a second exemplary embodiment of the disclosure. Spring detent 60 includes a generally flat base 62 having openings 64,66 for fastener securement of spring detent 60 to frame side rails 26,28. Cam portion 48 of resilient leg 38 preferably has side recesses 70, as best seen in FIG. 10, to permit access to openings 64. An elongated raised rib 68 is provided on base 62 beneath leg 38. Rib 68 provides strength and rigidity to base 62. Rib 68 also may function as a stop against actual movement of the detent. Spring detent 60 is otherwise similar to spring detent 36 illustrated in FIGS. 6-9, and like reference numerals are employed to indicate like components in both embodiments.

There thus has been disclosed a building window upper sash latch arrangement that fully satisfies all of the objects and aims previously set forth. The disclosure has been presented in conjunction with several exemplary embodiments, and additional modifications and variations have been discussed. Other modifications and variations readily will suggest themselves to persons of ordinary skill in the art. For example, the latches 38 also can be (and preferably would be) configured as tilt latches to permit tilting of upper sash 38 for cleaning purposes for example. The disclosure is intended to embrace all such modifications and variations as fall within the spirit and broad scope of the appended claims.

The invention claimed is:

1. A building window that includes:

a generally rectangular frame having an upper rail and opposed side rails, an upper sash and a lower sash independently movably mounted in said frame, a pair of laterally opposed spring detents mounted on said side rails adjacent to said upper rail, and a pair of laterally opposed latches at upper corners of said upper sash at positions to engage said spring detents as said upper sash is moved to a fully raised position, said latches being operable in cooperation with said spring detents to hold said upper sash in said fully raised position and being releasable from said spring detents to permit lowering of said upper sash, wherein each said spring detent has a resilient arm positioned to be engaged by an associated latch as said upper sash is moved toward said fully raised position, and wherein each said resilient arm has a cam portion disposed to be engaged by the associated latch as said upper sash is moved toward said fully raised position resiliently to urge said resilient arm laterally outwardly, and a second portion to cooperate with said latch to hold said upper sash in said fully raised position.

2. The window set forth in claim 1 wherein said second portion includes a ledge for supporting said latch in said fully raised position of said upper sash.

3. The window set forth in claim 2 wherein said ledge is at a downward angle.

4. The window set forth in claim 2 wherein each said spring detent includes a base secured to an associated side rail of said frame, and an inverted U-shaped portion connecting said base to said resilient arm such that said resilient arm is spaced from said base and resiliently movable toward said base by engagement with said latch.

5. The window set forth in claim 4 wherein said cam portion is flat and angles toward said base.

6. The window set forth in claim 5 wherein said base includes spaced oppositely extending hooks for securing said spring detent in an opening in said side rail.

7. The window set forth in claim 5 wherein said base includes openings for fastener securement of said spring detent to said side rail.

8. The window set forth in claim 1 wherein each of said latches includes a latch bolt and a spring biasing said latch bolt laterally outwardly, said latch bolt being movable laterally inwardly against said spring to clear said spring detent and permit lowering of said upper sash.

9. A building window that includes:

a generally rectangular frame having an upper rail and opposed side rails, an upper sash and a lower sash independently mounted in said frame, a pair of opposed spring detents mounted on said side rails adjacent to said upper rail, each said spring detent including a base secured to the associated side rail of said frame, a resilient arm and an inverted U-shaped portion connecting said resilient arm to said base such that said resilient arm is positioned laterally inwardly from said base, and a pair of laterally opposed latches at upper corners of said upper sash at positions to engage said spring detents as said upper sash is raised to said fully raised position, each of said latches including a latch bolt and a spring biasing said latch bolt laterally outwardly to engage an associated spring detent and hold said upper sash in said fully raised position, said latch bolt being movable laterally inwardly against said spring to clear said spring detent and permit lowering of said upper sash.

10. The window set forth in claim 9 wherein each said resilient arm includes a flat angulated cam portion spaced from said U-shaped portion and disposed to be engaged by the latch bolt of the associated latch as said upper sash is raised resiliently to urge said resilient arm laterally outwardly, and a second portion to cooperate with said latch bolts to hold said upper sash in said fully raised position.

11. The window set forth in claim 10 wherein said second portion of said spring detent includes a ledge for supporting said latch bolt in said fully raised position of said upper sash.

12. The window set forth in claim 11 wherein said ledge is at a downward angle.

13. The window set forth in claim 11 wherein said base includes spaced oppositely extending hooks for securing said spring detent in an opening in said side rail.

14. The window set forth in claim 12 wherein said base includes openings for fastener securement of said spring detent to said side rail.

* * * * *